United States Patent [19]

Nei et al.

[11] 4,245,928

[45] Jan. 20, 1981

[54] JOINING PROCESS OF PANEL POINTS FOR MEMBERS IN A MARINE STRUCTURE AND METHOD FOR THE CONSTRUCTION OF STRUCTURES IN ACCORDANCE WITH THE PROCESS

[75] Inventors: Motoo Nei; Eisaku Uchikawa; Ikuo Jo; Minoru Sato, all of Chiba, Japan

[73] Assignee: Kawasaki Steel Corporation, Kobe, Japan

[21] Appl. No.: 940,662

[22] Filed: Sep. 8, 1978

[30] Foreign Application Priority Data

Mar. 28, 1978 [JP] Japan ..... 53-35848

[51] Int. Cl.[3] ..... E02D 17/00

[52] U.S. Cl. ..... 405/195; 405/218

[58] Field of Search ..... 405/225, 227, 195, 208, 405/218, 221

[56] References Cited

U.S. PATENT DOCUMENTS

| | | | |
|---|---|---|---|
| 3,352,119 | 11/1967 | Manning | 405/225 |
| 3,457,728 | 7/1969 | Pogonowski | 405/227 |
| 3,482,408 | 12/1969 | Manning | 405/225 |
| 3,638,436 | 2/1972 | Pogonowski | 405/227 |
| 3,987,636 | 10/1976 | Hruska et al. | 405/225 |
| 4,077,224 | 3/1978 | Coone | 405/225 |

*Primary Examiner*—Dennis L. Taylor

*Attorney, Agent, or Firm*—Fidelman, Wolffe & Waldron

[57] ABSTRACT

The present invention discloses a method for the construction of a structure sufficiently reinforced particularly against a lateral force by driving the desired number of pile members into the water and integrally connecting these pile members with the brace members the connection of the pile members with the brace members is accomplished by providing a gap between the brace and pile members, and filling the gap with a filler joining material having a powerful bonding force, such as an expansive mortar. The connecting work is devised to be performed safely and accurately on the surface of the water.

6 Claims, 36 Drawing Figures

JOINING PROCESS OF PANEL POINTS FOR MEMBERS IN A MARINE STRUCTURE AND METHOD FOR THE CONSTRUCTION OF STRUCTURES IN ACCORDANCE WITH THE PROCESS

The present invention relates to a process for connecting brace members to a plurality of pile members driven into the water, in forming a marine structure.

When a marine structure is constructed, it is advantageous from the viewpoint of construction and execution if panel points for structural members can be joined in the water as used herein the term "panel point" denotes the region where a pile member and a brace member are joined. More broadly, the term includes the joining area of other structural members as well.

In the past, however, there has not been proposed a satisfactory method for securely joining the members at the panel points underwater. This is because of the fact that work in the water is subject to extremely many limitations as compared to work accomplished onshore.

Work by a diver poses a limitation in water depth, and there are many tasks such as welding or the like which are difficult to perform and tend to be inaccurate.

Further, the structure consists of several members and when these members are joined in the water, the members are rocked due to waves, water currents, etc., resulting in forming a difficulty in junction.

For these reasons, in the past, the joining of members in the water has been avoided and a jacket process has been employed in which a structure (jacket) preassembled on the ground is towed to the construction site where the structure is plunged into the water and secured to the bottom of the water by steel pipe foundation piles or the like.

However, the aforesaid jacket process has the following drawbacks.

(1) Generally, many a structure in this field is of the large-scale type and hence, there is a tendency to increase the cost of manufacture if manufactured on the ground.

(2) It is often difficult and expensive to carry a large-scale structure to the installation site.

(3) Generally, the earth and sand in the bottom of the water are soft and hence, a structure prefabricated on the land is poor in stability when it is installed.

(4) Thus, in the jacket process, steel pipe piles need be driven. However, the steel pipe used is of a dual construction and a large number of members is required, unnecessarily increasing the weight of the members.

For these reasons, the jacket process in which a structure is prefabricated on land entails enormous costs and requires extended time for completion.

The present invention therefore provides an arrangement wherein connecting at a brace member to a pile member driven into the water may be accomplished in good condition below the water particularly of the water depth of from 50 to 60 meters, wherein work can be carried out on the surface of the water, and wherein even in the case where it is difficult to fix the members due to oscillations resulting from wave action, current flow or the like, the panel points for the structural members may be securely joined and fixed.

It is therefore an object of the present invention to provide a joining method whereby joining of panel points for structural members in a marine structure may be securely accomplished in the water.

It is another object of the present invention to provide a joining method whereby joining of panel points in a marine structure may be easily and safely accomplished from a suitable position on the surface of the water.

It is a further object of the present invention to provide a process for the construction whereby a marine structure may be constructed at low cost, in a short period of time and securely.

The above and other objects and features of the invention will appear more fully hereinafter from a consideration of the following description taken in connection with the accompanying drawings wherein preferred embodiments are illustrated and claims.

Figure 24:
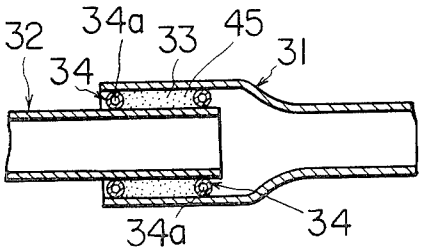
Figure 25:
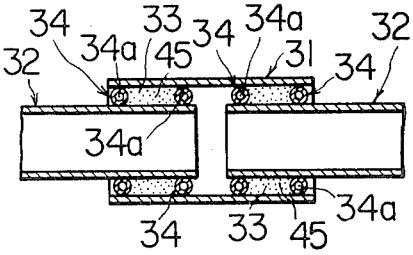
Figure 22:
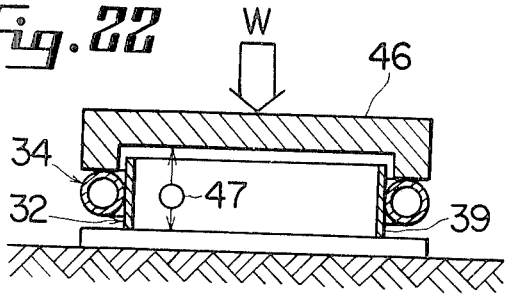
Figure 20A:
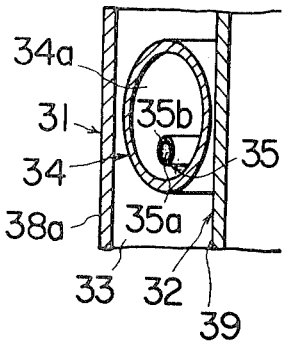
Figure 23:
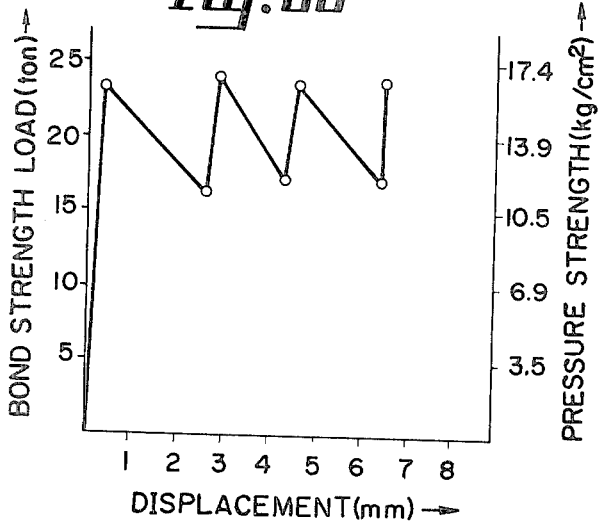
Figure 20B:
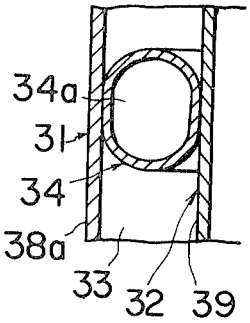
Figure 21:
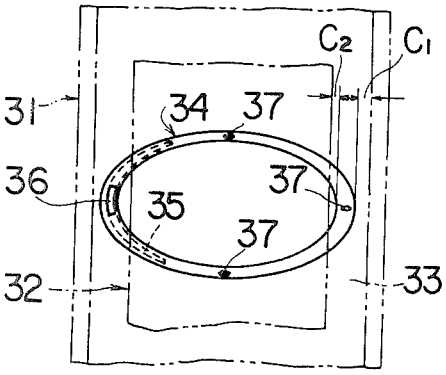
Figure 18:
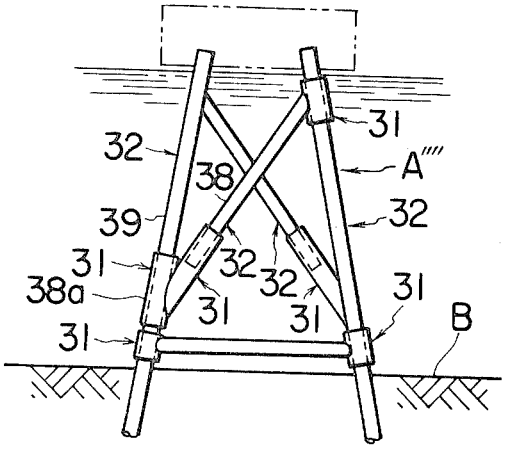

FIGS. 18–25 respectively show the processes of the present invention using explosive pipes in which:

FIG. 18 is a front view of a marine structure constructed in accordance with the process of the present invention;

FIGS. 19A, 19B, 19C and 19D are respectively perspective views in section showing one embodiment of execution in which panel points are joined by the use of the explosive pipes in the order executed;

FIGS. 20A and 20B are respectively part-side sections showing the relationship between the explosive pipe and the member, one before pressure joint (FIG. 20A) and the other after pressure joint (FIG. 20B);

FIG. 21 is an explanatory view showing a positional relation between the explosive pipe and the member;

FIG. 22 shows a bond testing set for an explosive pipe charged into the panel point in accordance with the process of the present invention;

FIG. 23 is a diagram showing the pressure strength of the explosive pipe obtained by the testing set of FIG. 22; and FIGS. 24 and 25 are respectively explanatory views showing the other different embodiments of execution using the explosive pipe in accordance with the present invention.

Specific embodiments of the present invention will now be described with reference to the accompanying drawings.

Figure 1A:
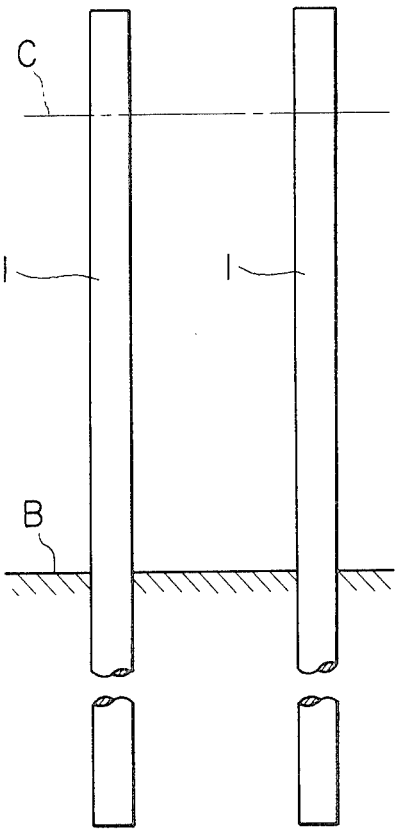
FIGS. 1A, 1B and 1C are respectively front views showing one embodiment of execution in accordance with the present invention in the order executed.

Referring first to FIGS. 1A, 1B and 1C through FIGS. 5A, 5B and 5C, the process of the present invention is characterized by opposedly driving a plurality of pile members 1, 1 in pairs (two members constitute a pair in the illustrated embodiment) into the water (as shown in FIG. 1A), placing brace members 2, 3 and outer pipes 4, 4, 5, 5, corresponding to the pair of pile members 1, 1, over the pair of pile members 1, 1 with a gap 6 formed therebetween (as shown in FIGS. 1B, 1C and FIGS. 5A, 5B), and filling the gap 6 between both members with a filler joining material 7 to join the both members.

In the illustrated embodiment, the pile members 1, 1 comprise steel pipe piles vertically driven into the bottom of the water B by a pile driver on the piling boat so as to form the marine structure A, and a horizontal brace member 2 and diagonal brace members 3, which serve to strengthen these post members 1, 1, are mounted on the pile members 1, 1.

Figure 1B:
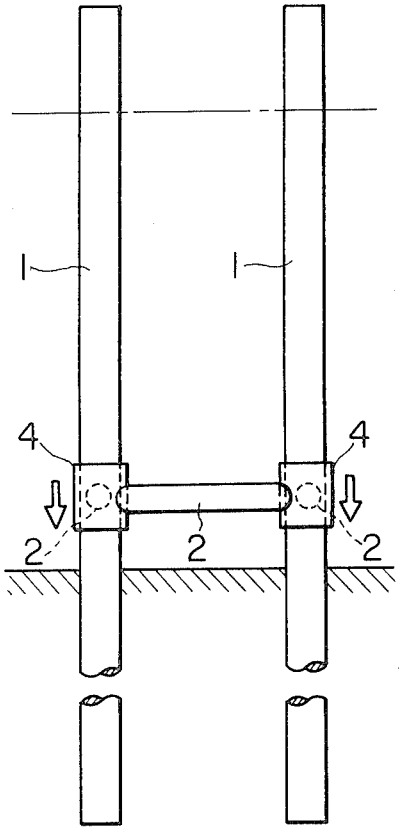

These brace members 2, 3 may be mounted on the pile members 1, 1 in the following procedure. First, as shown in FIG. 1B, the outer pipes 4, 4 disposed on opposite ends of the horizontal brace member 2 corresponding to the pile members 1, 1 are placed over the pile members 1, 1 from the tops thereof.

Then, the horizontal brace members 2 is mounted at its given level on the pile members 1, 1 by joining the outer pipes 4, 4 with the pile members 1, 1 through the joining material 7.

Figure 1C:
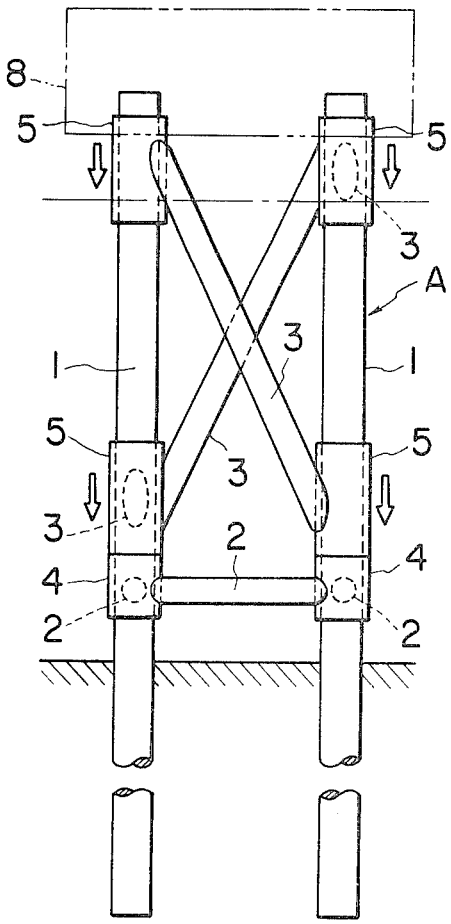

Next, as shown in FIG. 1C, the outer pipes 5, 5 disposed on opposite ends of the diagonal brace members 3 corresponding to the pile members 1, 1 are placed over the pile members 1, 1 from the tops thereof. The diagonal brace members 3 are mounted at their given level by joining the outer pipes 5, 5 with the post members 1, 1 through the filler joining material 7.

In a final step, the reinforcement and moulding are arranged on the upper end portions of the pile members 1, 1 and concrete 8 is placed therein to complete construction of the marine structure A.

Figure 2:
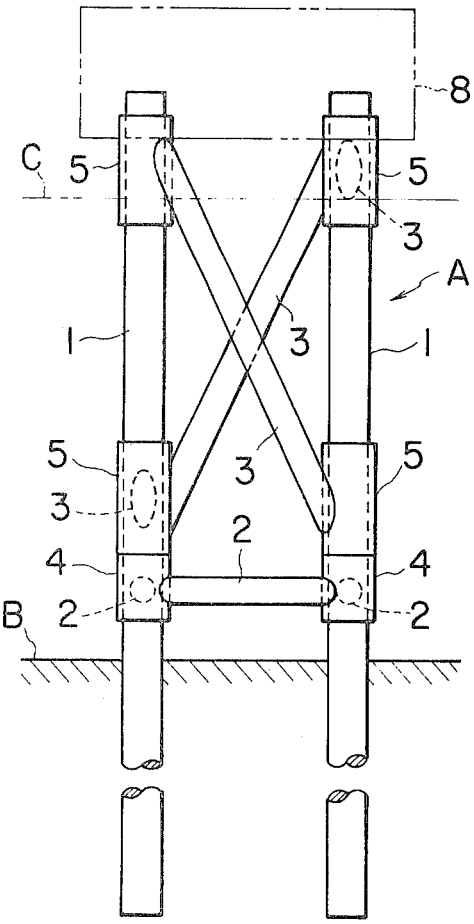
FIG. 2 is a side view of a marine structure constructed in accordance with the process of the present invention.
Figure 3:
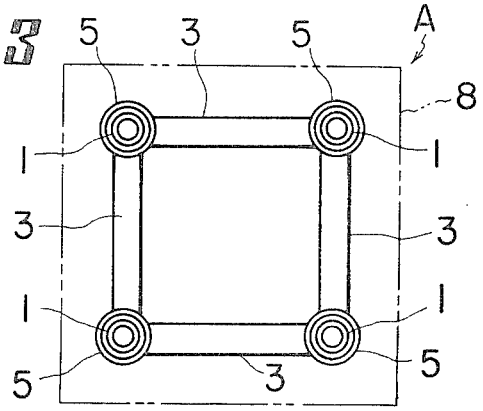
FIG. 3 is a plan view of the same.

In the drawings, there is shown an embodiment of the marine structure A in which the pair of pile members 1, 1 comprising four post members 1, . . . constitute four sets, as shown in FIGS. 1C, 2 and 3.

Figure 4:
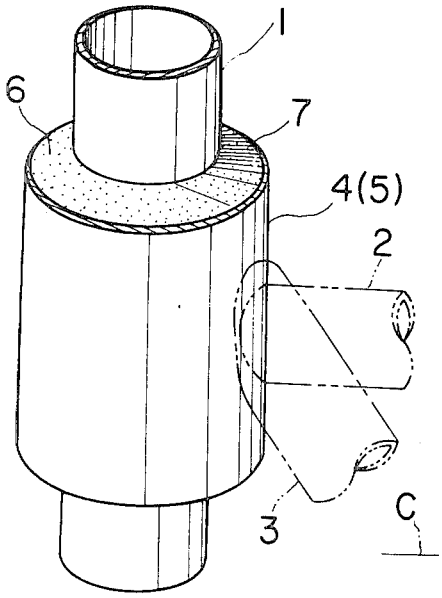
FIG. 4 is a partially cutaway perspective view showing a state where outer pipes are placed over a pile member.

The pile members 1, 1 are joined with the outer pipes 4, 4, 5, 5 through a filler joining material 7 such as expansive mortar cement, as shown in FIG. 4.

Figure 5A:
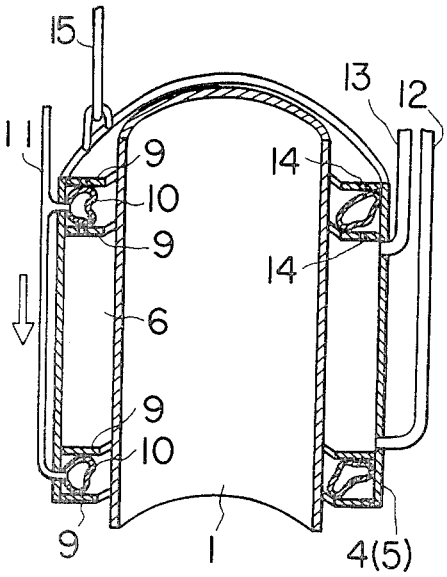
FIGS. 5A, 5B and 5C are respectively perspective views in section showing one embodiment of execution, in which outer pipes are placed over a pile member, in the order executed.
Figure 5B:
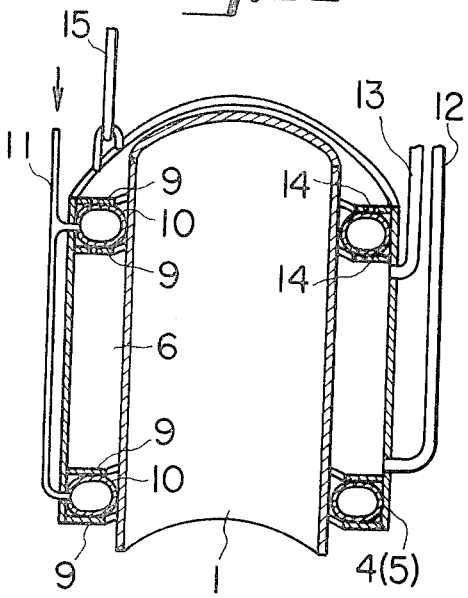
Figure 5C:
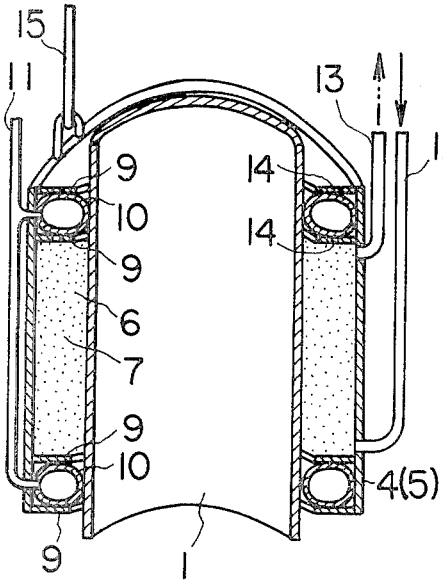

This joining may be accomplished as shown in FIGS. 5A, 5B and 5C. That is, the outer pipes 4, 4 and 5, 5 are placed over the pile members 1, 1 with the gap 6 formed therebetween, which gap is filled, in a state where both sides of the gap between the members are closed, with a filler joining material 7 such as expansive mortar cement, having the properties of exerting expansive pressure and having considerable bonding force (as shown) in FIG. 5C). In this manner, both members may be joined with the help of the expansive pressure and bonding force of the expansive mortar as the filler joining material 7.

Prior to entry of the joining operation, at upper and lower ends of the outer pipes 4, 4 and 5, 5 there are fixedly mounted radially inwardly extended flanges 9, 9 in spaced relation with each other, and these flanges 9, 9 each has a rubber tube 10, wound about the entire periphery thereof, the rubber tube 10 being connected to a source of compressed air supply (not shown) through an air pipe 11. The outer pipes 4, 4 and 5, 5 are respectively provided with a joining material pouring pipe 12 for pouring and filling the gap 6 with a filler joining material 7 and a joining material ensuring pipe 13 to ensure that the gap 6 has been poured and filled with the expansive joining material 7.

If the joining material ensuring pipe 13 extends up to the surface of the water, it is possible to ensure, on the water, that the gap has been filled with the filler joining material 7, and on the other hand, if the use of a submarine TV camera, a small submarine boat, a diver, etc. is made, it is possible to similarly ensure, in the water, that the gap filled with the filler joining material 7.

Air vent holes 14 . . . are open to the upper flanges 9, 9 in order to easily remove air from the interior of the gap 6.

The outer pipes 4, 4 and 5, 5 are hung down by a wire rope 15 to be moved down until they reach the given level of the post members 1, 1 (as shown in FIG. 5A), and in this state, compressed air is fed into the upper and lower rubber tubes 10, 10 through the air pipe 11 (as shown in FIG. 5B).

With this, both sides of the gap 6 are closed by the inflated rubber tubes 10, 10, and the outer pipes 4, 4 and 5, 5 are centered. In this state, the gap 6 is filled with the filler joining material 7 through the joining material pouring pipe 12 from a joining material pouring device (not shown) mounted on a working boat, as shown in FIG. 5C.

This filler joining material 7 may be obtained, for example, by mixing 8 to 15% commercially available expansive material such as TASCON (a trademark, manufactured by DENKA KABUSHIKI KAISHA), JIPCAL (a trademark, manufactured by ASANO CEMENT KABUSHIKI KAISHA) and the like, into Portland cement, in order to obtain expansive properties when mortar is settled. The expansive pressure at the time of settlement and the bonding force cooperate to firmly join the outer pipes 4, 4 and 5, 5 with the post members 1, 1.

After the filler joining material 7 has been settled, the air pipe 11, the joining material pouring pipe 12 and the like can be removed.

Figure 6:
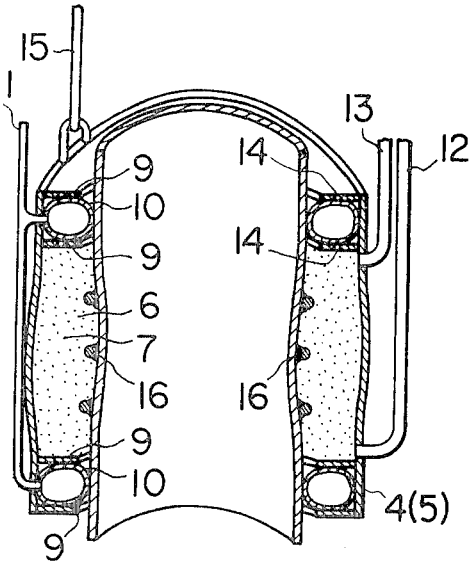
FIG. 6 is a perspective view in section showing one embodiment of a joint construction of panel points using a filler joining material.

This joining construction is exaggerately shown in FIG. 6, in which due to the expansive pressure of the filler joining material 7, peripheral walls of the pile members 1, 1 are drawn and deformed so as to have smaller diameters, whereas peripheral walls of the outer pipes 4, 4 and 5, 5 are expanded to form large diameters.

Thus, in addition to the bonding force of the filler joining material 7 to the pile members 1, 1, the settled filler joining material 7 exerts a wedge action on the pile members 1, 1 whereby the outer pipes 4, 4 and 5, 5 may be more firmly joined with the pile members 1, 1.

It should be noted that in order to further increase the bonding force to the pile members 1, 1 in addition to the wedge action of the filler joining material 7 as described above, round bars are wound along the entire outer peripheral surface of the joining portions of the pile members 1, 1, and projections 16 . . . extended from the gap 6 between the members may be fixedly disposed.

Also, presurized water substituted for compressed air may be introduced into the rubber tubes 10, 10 for expansion thereof.

Figure 7A:
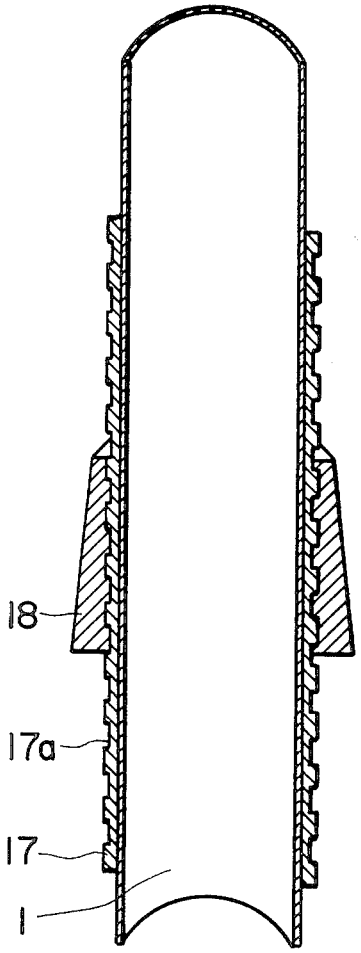
FIGS. 7A, 7B, 7C and 7D are respectively perspective views in section showing another form of execution of the present invention in the order executed.
Figure 7B:
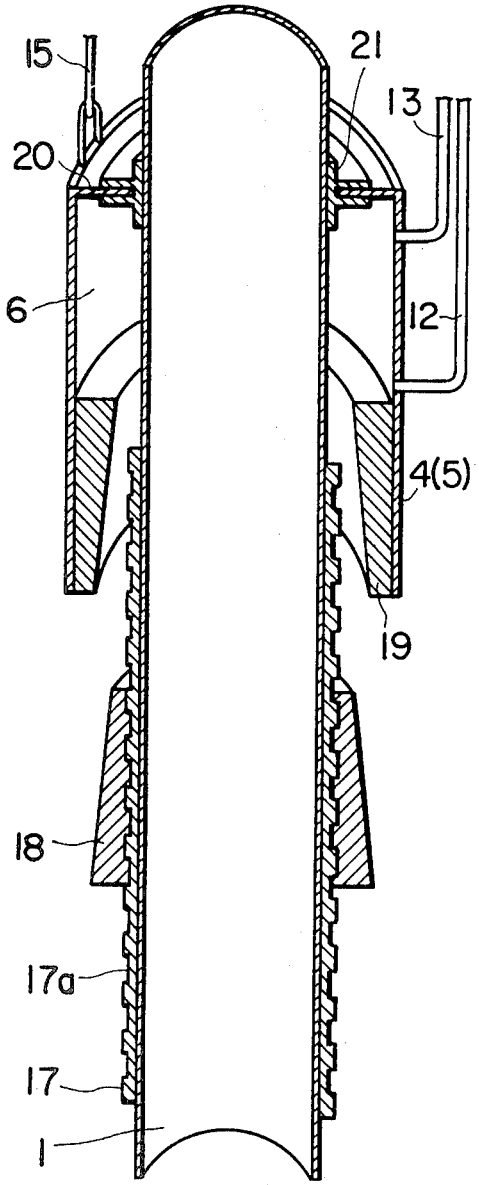
Figure 7C:
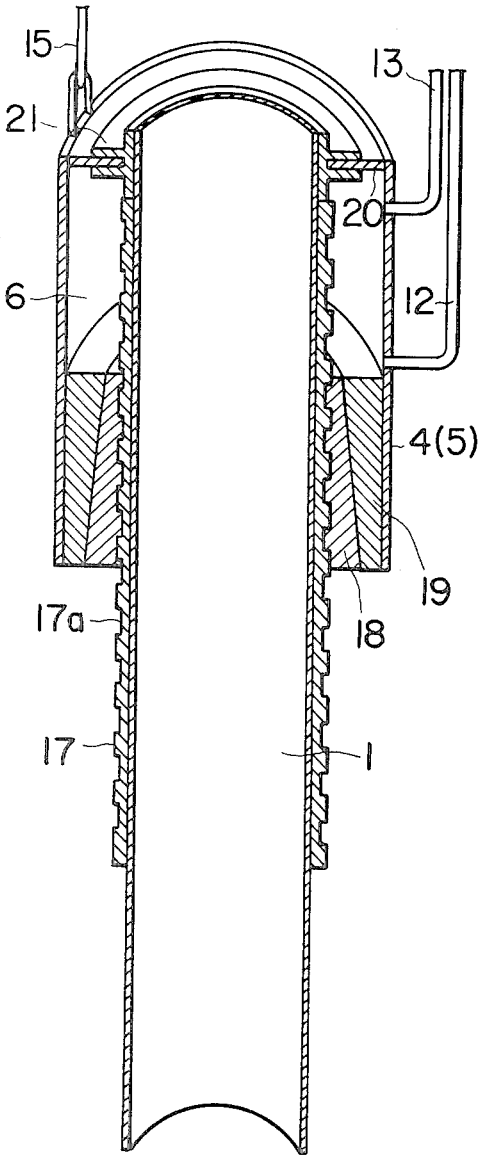
Figure 7D:
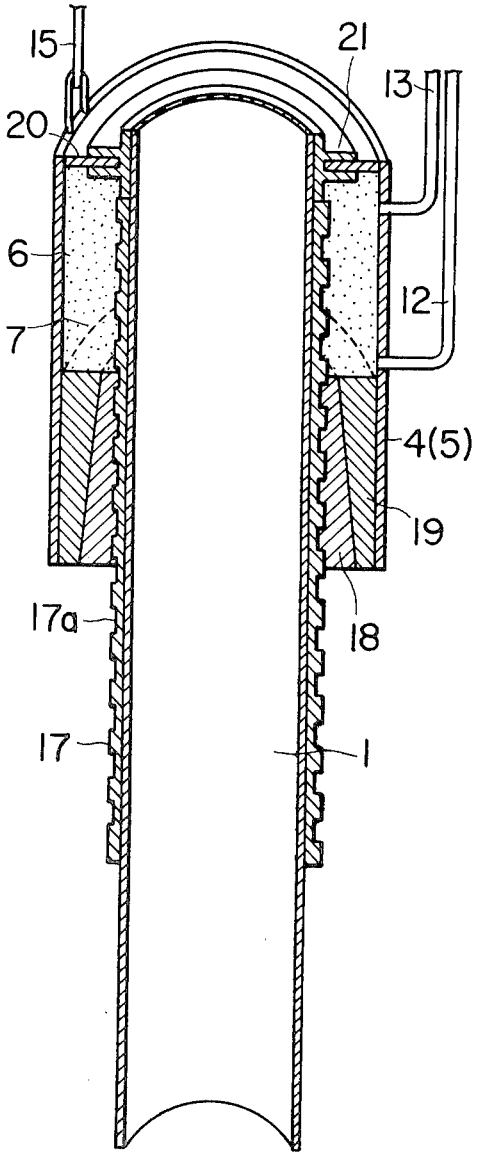

Turning now to FIGS. 7A, 7B, 7C and 7D, another form of execution in accordance with the present invention is shown. First, as shown in FIG. 7A, a pipe member 17 formed at its outer peripheral surface with threaded portions 17*a* is fixed by welding or the like in position on the outer peripheral surface of the pile member 1, a wedge-like joining appliance 18 is threadably mounted on the threaded portions 17*a* of the pipe member 17, the outer pipes 4 and 5 on the inner surface of which is fixed by welding or the like a wedge-like joining appliance 19 are placed over the pile member 1 with the gap 6 formed therebetween (as shown in FIG. 7B), and in a state where tapered surfaces of the joining appliances 18 and 19 are placed in abutment (as shown in FIG. 7C), the gap 6 is filled with the filler joining material 7 through a joining material pouring pipe 12 (as shown in FIG. 7D).

In this embodiment, a radially inwardly extended flange plate 20 is fixed by welding or the like on the upper end of the outer pipes 4 and 5, the flange plate 20 having an inner peripheral edge provided with a rubber plate 21 for preventing leakage of a joining material so as to cover the top of the gap 6, and the fact that the gap 6 has been filled with the filler joining material 7 is ensured by a joining material ensuring pipe 13.

Figure 8:
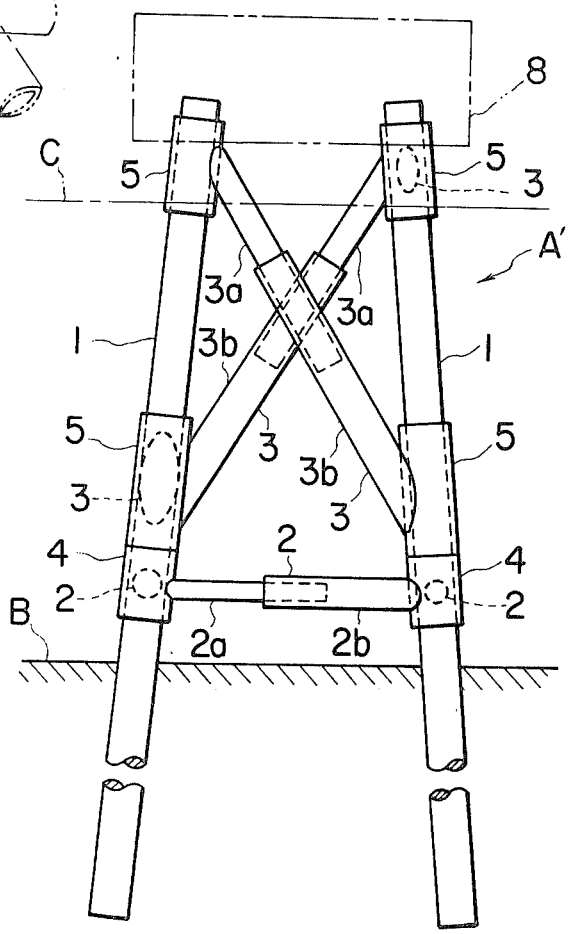
FIGS. 8, 9 and 10 are respectively front views showing embodiments in which the process of the present invention is applied to the other different marine structures.

While in the illustrated embodiment, the pile members 1, 1 have been described to be vertical and parallel, the present invention is not limited thereto but may also be used to construct a marine structure A′ in which the post members 1, 1 are inclined in such a manner that they come close to each other as they extend upwardly, as shown in FIG. 8. In the marine structure A′, the horizontal brace member 2 is divided into an inner member 2*a* and an outer member 2*b* placed thereover and the diagonal brace member 3 is also divided into an inner member 3*a* and an outer member 3*b* placed thereover so that the horizontal brace member 2 and the diagonal brace member 3 may be adjusted in length by expansion thereof.

The inner member 2*a* and the outer member 2*b*, and the inner member 3*a* and the outer member 3*b* are respectively finally are joined with each other into an integral body. This joining may be accomplished in a manner similar to that of the embodiment previously described in which the pile member 1 is joined with the outer pipes 4 and 5.

It should be further noted in the marine structure A described in the previous embodiment that the brace members 2 and 3 are divided as shown in FIG. 8 to absorb an error in spacing between the pile members 1 and 1.

Figure 9:
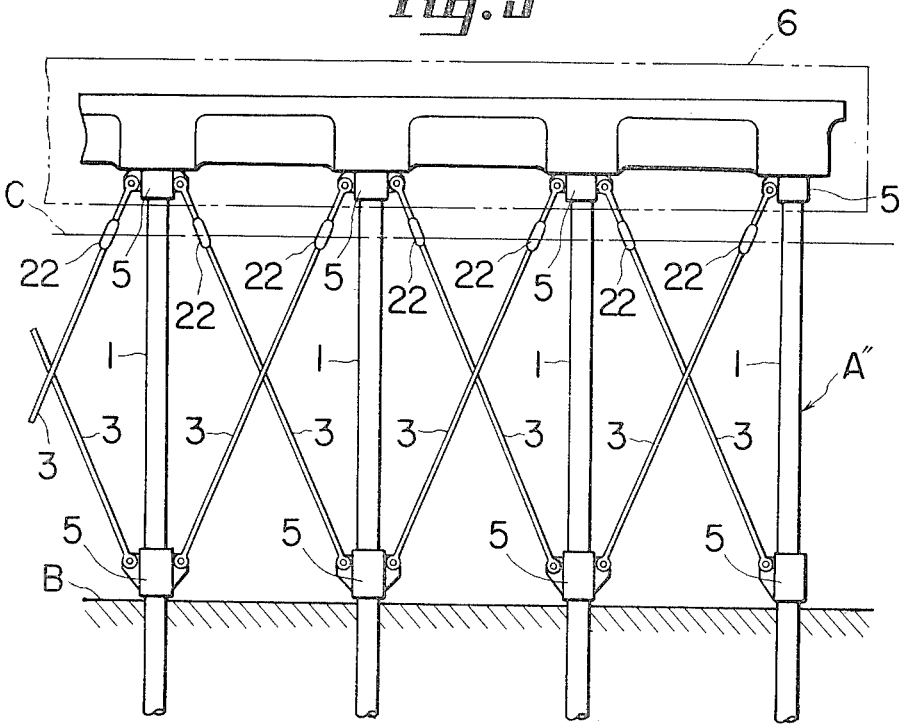
Figure 10:
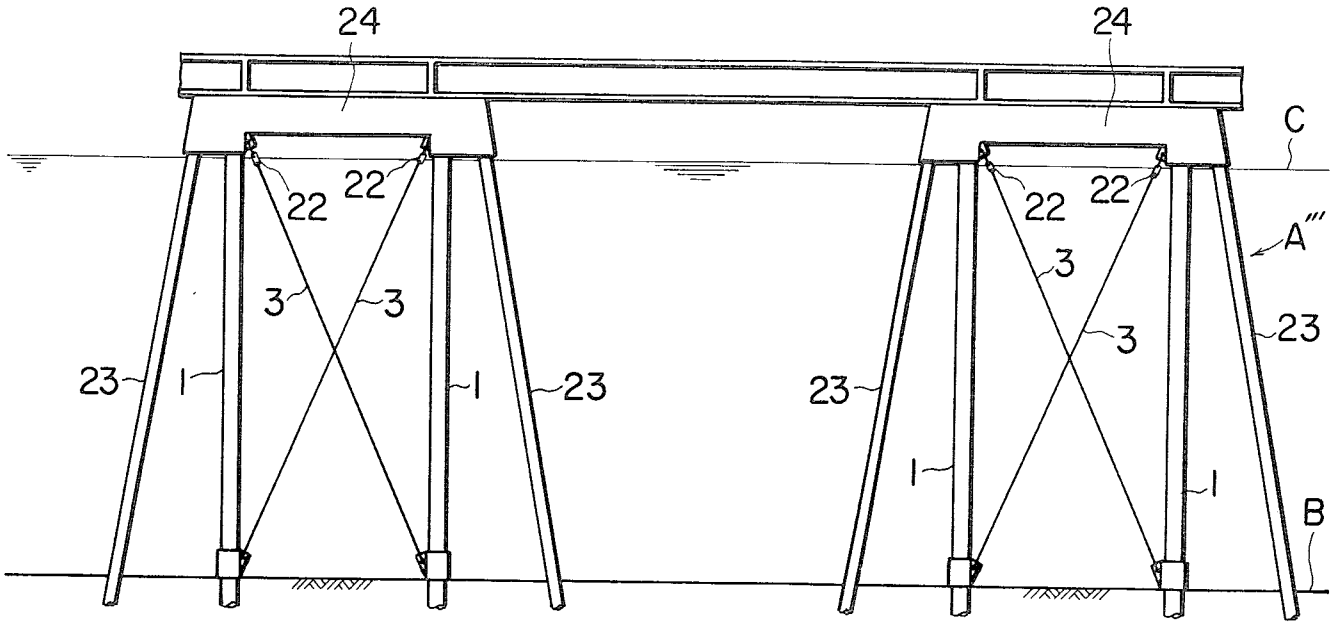

FIGS. 9 and 10 illustrate embodiments in which the process of the present invention is applied to marine structures A″ and A‴ using tie rods in the diagonal brace members 3. In this case, the length of the diagonal brace member 3 may be adjusted by a turnbuckle 22. In FIG. 10, there are shown diagonal pile members indicated at 23 to support pile members 1, 1, and top portions of the pile members 1, 1 and the diagonal pile members 23 are connected by transverse members 24. In this case, the pile post members 1, 1 and diagonal pile members 23 may be joined with the transverse members 24 in a manner, for example, similar to that has been employed when the pile member 1 and the outer pipes 4, 5 are joined in the aforementioned embodiment.

When the pile members are left in the water (in the sea) for a long period of time, there occurs a state where seaweeds, shells, duckweed or rust are adhered to or generated in the surfaces thereof, resulting in faulty joined surfaces. In this case, surfaces to be joined should be cleaned on the surface of the water by a cleaning appliance such as brushes (not shown) before entry into execution of the aforementioned process. In the drawings, reference character C designates the surface of the water.

Figure 11:
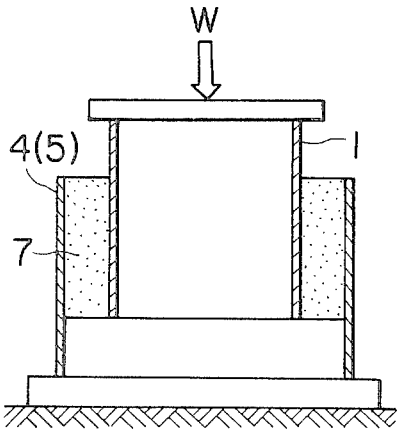
FIG. 11 shows a testing set for obtaining the bonding strength of expansive mortar filled into the panel point in accordance with the process of the present invention.
Figure 12:
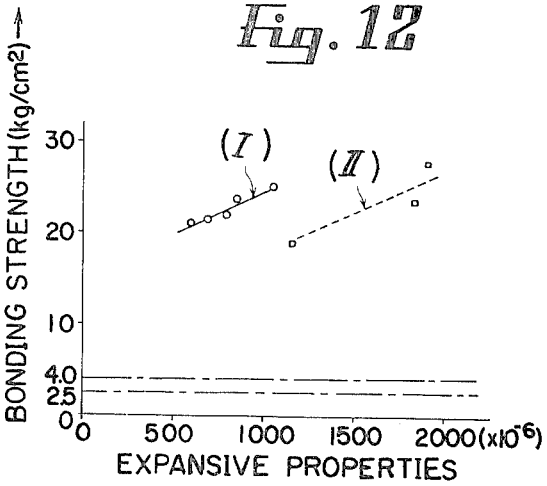
FIG. 12 is a diagram showing the relationship between the expansive property and the bonding strength of the expansive mortar obtained by the testing set of FIG. 11.

FIG. 11 shows a testing set for obtaining the bonding strength of expansive mortar 7 filled into the panel points for members in accordance with the process of the present invention. FIG. 12 shows the relationship between the expansive property and the bonding strength of the expansive mortar obtained by applying a load W to the testing set to fail the expansive mortar. In FIG. 12, there is shown a line I which indicates a variation in the bonding strength in the case TASCON is used as the expansive material and the quantity of addition of TASCON is varied to vary the expansive properties whereas a line II indicates a variation in the bonding strength in the case JIPCAL is used as the expansive material and the quantity of addition of JIPCAL is varied to vary the expansive properties. In FIG. 12, both lines I and II indicate that the higher the expansive properties the higher being the bonding strength. However, the line II is higher in the expansive properties than that of the line I but is not necessarily high in the bonding strength. This results from a difference in an expansive mechanism of the expansive material and a quantity of generation of bleeding of mortar. Accordingly, it is found that the expansive material of high expansive properties does not always exhibit a high bonding strength.

According to the process of the present invention, the design bonding strength is generally from 2.5 to 4.0 $kg/cm^2$ but the bonding strengths shown in lines I and II exceed 20 $kg/cm^2$, which is indicative of a sufficient safety factor.

Figure 13:
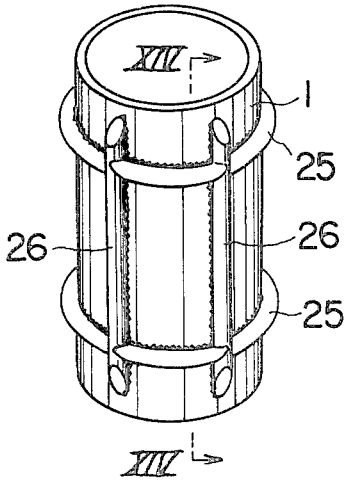
FIG. 13 shows an embodiment in which projections are disposed on the outer peripheral surface of an inner pipe of the panel point.
Figure 14:
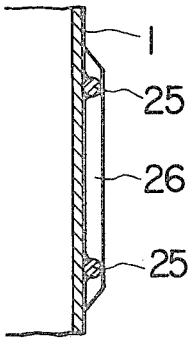
FIG. 14 is a sectional view taken on line XIV—XIV of FIG. 13.
Figure 15:
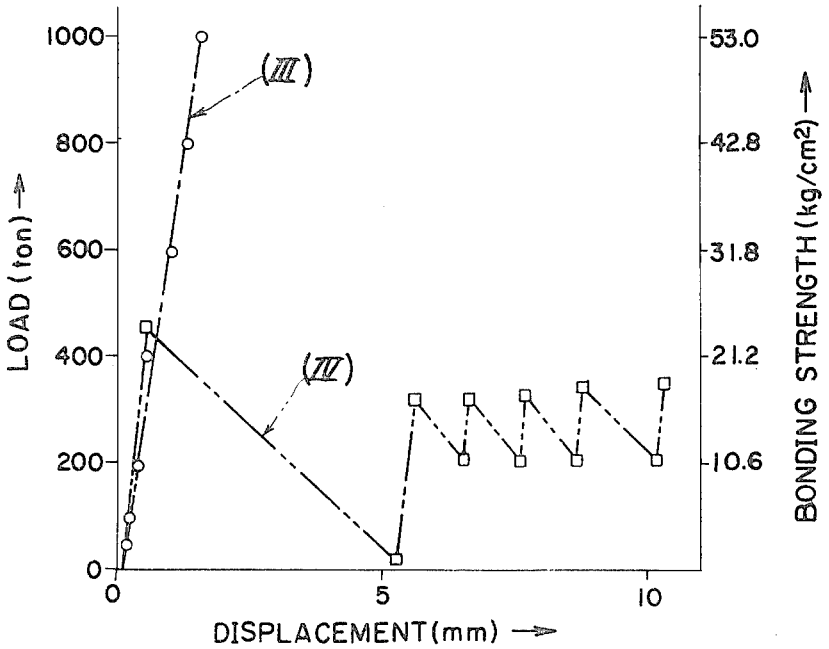
FIG. 15 is a diagram showing the bonding strength of the panel point having the inner pipe formed with the projections as shown in FIGS. 13 and 14 resulting from the provision of expansive mortar as compared to that with projections not being provided.

In the case the pile member 1 in a panel point for members has round bars wound about the entire outer peripheral surface thereof to fixedly form projections 25 and 25 as shown in FIGS. 13 and 14, the bonding strength of expansive mortar is shown by line III in FIG. 15 whereas the bonding strength in the case a projection is not provided is shown by line IV in FIG. 15. It will be obvious from FIG. 15 that in order to increase the bonding strength of the expansive mortar to the pile member (inner pipe) 1, the projections 25 and 25 as shown may be mounted. However, in the case the length of the post member 1 extended into the earth in the bottom of the water is varied, a position of the panel point of the pile member 1 changes so that these projections need be fixedly mounted over wide range. Generally, however, the sufficient bonding strength may be obtained without provision of the projections and therefore, it is not necessary to provide the projections. Thus, the projections may be provided when a particularly great bonding strength is required or when a particularly high safety factor is required. In this case, sliders 26 . . . may be incorporated so as not to impair workability as a result that the outer pipe is caught in the projections 25 when the former is placed over the pile member 1.

Figure 16:
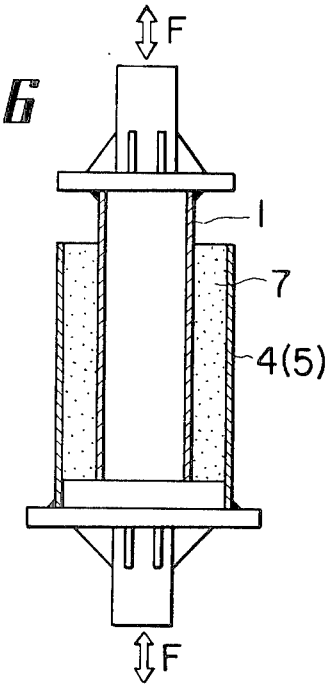
FIG. 16 shows an alternate shearing repetition testing set for obtaining the fatigue resisting strength of the panel point in accordance with the process of the present invention.
Figure 17:
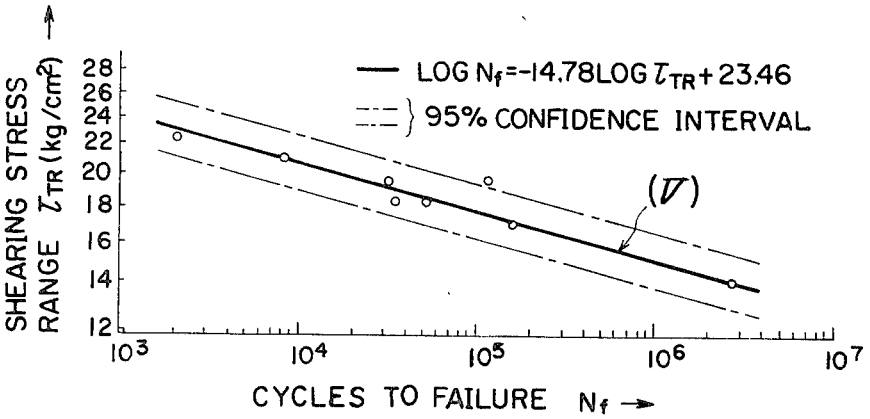
FIG. 17 is a diagram showing the relationship between the shearing stress obtained by the testing set of FIG. 16 and the number of cycles to failure.

Further, the marine structure is often subject to repetitious external forces such as waves, wind force, access of boats to shore, etc. It is therefore necessary for the panel points for members in accordance with the process of the present invention to possess a fatigue resisting strength enough to withstand such repetitious external forces. To ensure this, the fatigue resisting strength was obtained by the alternate shearing repetition testing set shown in FIG. 16. The relationship between the shearing stress obtained by the testing set of FIG. 16 and the number of cycles to failure is shown by line V of FIG. 17. It is found from the line V in FIG. 17 that the decrease in strength of the alternate repetitious force due to fatigue is extremely gentle as compared to general welded steel construction, thus affording an excellent characteristic in fatigue resistance, and that since fatigue strength $\tau_{TR}$ of 2,000,000 times is 15 kg/cm$^2$, there possesses sufficient fatigue properties as compared to the standard design bonding strength (2.5 to 4.0 kg/cm$^2$) in accordance with the process of the present invention.

Figure 19C:
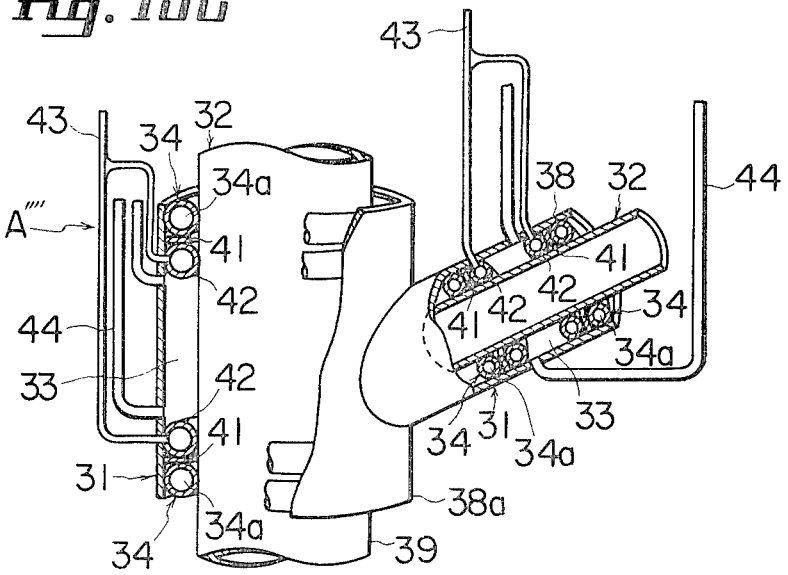
Figure 19D:
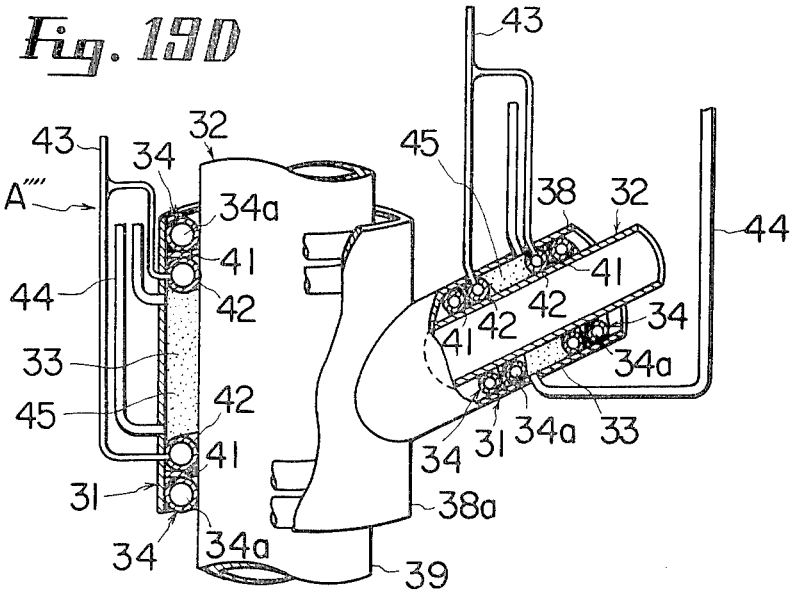
Figure 19A:
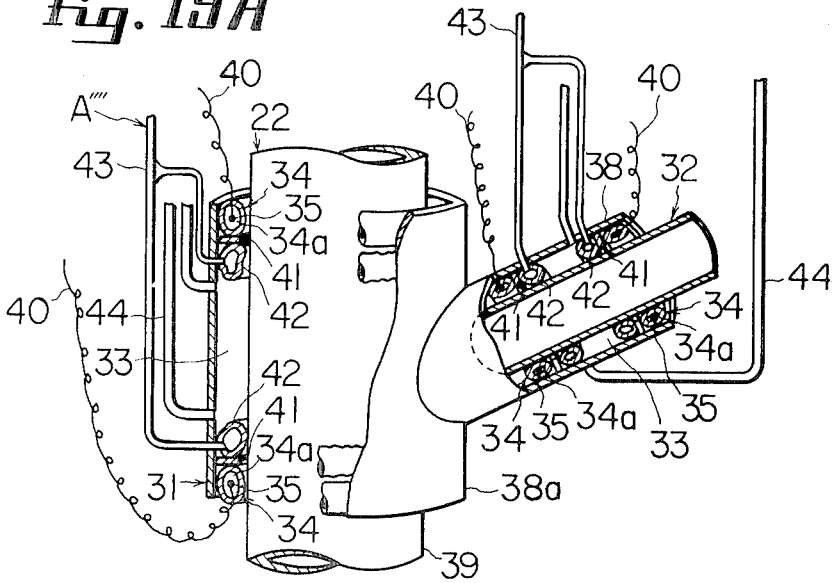
Figure 19B:
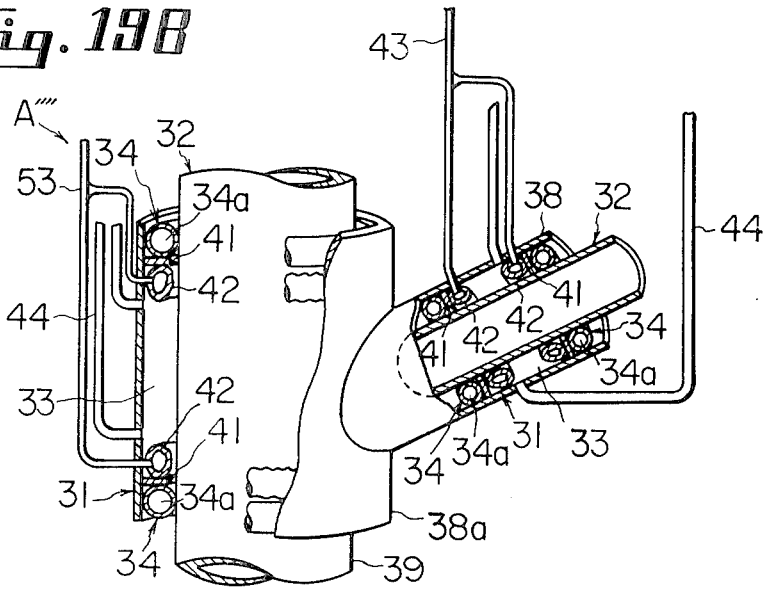

Next, the process of the present invention using explosive pipes shown in FIGS. 18 to 25 will be described. Referring to FIG. 18 and FIGS. 19A, 19B, 19C and 19D, the process of the present invention is characterized, in joining members 31 and 32 which constitute a marine structure A'''', by placing one member 31 over the other member 32 with a gap 33 formed therebetween, interposing explosive pipes 34, 34 in the gap 33 between said members, the explosive pipes each having a flattened cross section and having an interior 34*a* charged with explosives 35 (as shown in FIG. 19A), utilizing an idea, in which the cross sectional shape of the explosive pipe 34 is restored to its circular shape by the explosive force of the explosives 35, to press the explosive pipe 34 against the members 31 and 32 so that both the members 31 and 32 are fixed (as shown in FIG. 19B), and filling the gap 33 with a filler joining material 45 for joining the members 31 and 32 in a state where opposite sides of the gap between the members 31 and 32 is closed (as shown in FIGS. 19C and 19D).

That is, the explosive pipe 34 comprises, for example, a carbon steel pipe (a gas pipe SGP) as shown in FIGS. 20A, 20B and FIG. 21.

This SGP pipe is advantageously used since it has a good workability, is less hardened by working, can relatively maintain its ductility and malleability so as not to fail easily, and is brought into good intimate contact with members 31 and 32 to be combined.

The explosive pipe 34 has its cross sectional shape flattened into an oval and is curved in a direction of a single spindle of flat section to form a ring-like configuration. The explosive pipe 34 further has its outside ring diameter made slightly smaller than the inside diameter of the member 31 while its inside ring diameter is slightly larger than the outside diameter of the member 32, and has suitable clearances $C_1$ and $C_2$ so as to have a shape not imparing the fitting together operations.

The explosive pipe 34 further has its wall formed with a charging port 36 through which the explosives 35 are charged, and has small holes 37 . . . opened to fill the interior 34*a* with water substituted for air when the pipe is submerged.

Experiments made by the present inventors show that the explosives 35 charged into the interior 34*a* of the explosive pipe 34 preferably have an explosion speed at the time of explosion in the range from about 300 to about 500 m/sec. At high explosion speed (2,000 to 6,000 m/sec.), water in contact with the outer surface of the explosive pipe 34 fails to achieve the object of forming a pressure joint with members 31 and 32 in the form of a rigid body. To meet this objective, there is used, for example, an explosive in which commercially available gunpowder 35*a* is enclosed in and covered with a thick-wall vinyl chloride tube 35*b* in consideration of water resistance and shock resistance requirements.

In the following, a description will be made of an embodiment in which an outer pipe 38*a* of a connecting member 38 as one member 31 is connected to a steel pipe pile 39 as the other member 32. The steel pipe pile 39 is driven into the bottom of the water B, and an outer pipe 38*a* is placed over the thus driven steel pipe pile 39 by lifting into place the connecting member 38. A gap 33 is formed between the outer pipe 38*a* and the steel pipe pile 39, into which gap the explosive pipes 34, 34 constructed as set forth above are inserted (as shown in FIG. 19A and FIG. 20A).

Interior 34*a* of the explosive pipes 34, 34 is filled with water substituted for air through the small holes 37 . . . , thereafter the gunpowder 35*a* is electrically exploded to thereby instantaneously deform the cross sectional shape of the explosive pipes 34, 34 into a circular shape, whereby the explosive pipes are brought into pressure joint contact with the outer pipe 38*a* and the steel pipe pile 39 (as shown in FIG. 19B and FIG. 20B).

It should be noted that the small holes 37 . . . open in the explosive pipes 34, 34 are provided to moderate the start of shock pressure produced at an early stage of explosion and to prevent breakdown of the explosive pipes 34, 34.

As described above, the explosive pipes 34, 34 are brought into pressure joint formation with the outer pipe 38*a* and the steel pipe pile 39 whereby the outer pipe 38*a* is integrally connected with the steel pipe pile 39 as shown in FIG. 19B. In this state, radially inwardly extended flanges 41 and 41, which are positioned internally of the explosive pipes 34, 34, are fixedly mounted on the outer pipe 38*a*. These flanges 41 and 41 have rubber tubes 42 and 42 wound about the entire inner periphery thereof. The rubber tubes 42 and 42 are connected to a compressed air source (not shown) through an air pipe 43 so that the rubber tubes 42 and 42 may be inflated by compressed air fed from the compressed air source thereto to close opposite sides of the gap 33 and to center the outer pipe 38*a* (as shown in FIG. 19C). In this state, the gap 33 formed between the rubber tubes 42 and 42 is filled with a filler joining material 45 having both expansive pressure and bonding strength, for example, such as expansive mortar, from a mortar pouring pipe 44 connected to the outer pipe 38*a* to thereby join the outer pipe 38*a* with the steel pipe pile 39 (as shown in FIG. 19D).

It should be noted that in place of the aforementioned rubber tubes 42 and 42, the flanges 41 and 41 may have vinyl tubes, for example, as seals wound internally thereof and the gap 33 is filled with the filler joining material similar to that as described above to achieve the same effect.

FIG. 23 shows the pressure joining strength of the explosive pipe 34 and the steel pipe pile 39 obtained by the bond testing set shown in FIG. 22 in the above-mentioned embodiment.

In FIG. 22, the explosive pipe 34 comprises a SGP pipe, the steel pipe pile 39 has its outside diameter 914.4 mm and wall thickness 12.7 mm, and the gunpowder 35*a* charged is 230 g/m. When the explosive pipe 34 was exploded and burned at the water depth of 5 m, there hardly appeared a water column on the surface of the water and noises were about 30 phons at a point 5 m apart. FIG. 23 shows the measured results of pressure joining strength obtained by the relationship between a load W, which is applied to a loading plate 46 placed on the explosive pipe 34 as a testpiece, and displacement measured by a dial gauge 47. The maximum bond load was 24 tons and the explosive pipe 34 was brought into pressure joint contact with the steel pipe pile 39 over the entire periphery of width 5 m thereof.

It has been therefore found that the pressure joining strength of the explosive pipe 34 was expected to be about 17 kg/cm$^2$.

The joining of parts in the marine structure A'''' other than the above parts in the aforementioned embodiment may be accomplished in a manner similar to that described above by a combination of one member 31 and the other member 32, and the explosives in joints may be exploded and burned at the same time.

FIGS. 24 and 25 respectively illustrate modified embodiments of the present invention, in which the gap 33 formed between opposite sides closed by the explosive pipes 34 and 34 is filled with a filler joining material 45 to join one member 31 with the other member 32.

It will be understood that the process of the present invention may be applied to joining of panel points in various kinds of marine structures irrespective of position below or above the surface of the water.

As explained above, the process of the present invention comprises opposedly driving a plurality in pair of pile members into the water, placing outer pipes of brace members corresponding to the pair of pile members over the pair of pile members with a gap formed therebetween, and filling the gap between both members with a filler joining material to join the both members. With this arrangement, it is not necessary to preassemble a marine structure on shore as is so required by the prior art jacket process, but an outer pipe of a brace member is placed over a pile member driven into the water and the brace member may be installed on each of the pile members to thereby construct the marine structure in a short period of time, at low cost and securely.

In addition, in the process of the present invention, the pairs of plural pile members are driven opposedly to one another into the water, outer pipes disposed on both ends of the brace members for connecting these pile members to each other are slipped over said pile members, the outer pipes are located with a predetermined gap formed between the outer pipe and the pile members; thereafter the gap is closed off by expansion of a rubber tube and is filled with a filler joining material for joining both members.

With this arrangement, the attachment of the pile members and brace members in a marine structure may be securely accomplished through working on the water surface, without requiring underwater work by a diver. The relative positional relationship of the members to each other is freely determined by this method and the joining positions or locations are suitably selected even when it is difficult to fix the members due to oscillations resulting from wave action, current flow, or the like.

Further, in accordance with the process of the present invention, the filler joining material charged into the gap between the members comprises expansive mortar having both expansive pressure and bonding strength. Both members are firmly joined through the aforesaid expansive pressure and bonding strength of expansive mortar. Projections provided at least on the inner member of the inner and outer members may be extended into the gap between the members to thereby cope with the case where a particularly great bonding strength is required or with the case where a particularly high safety factor is required.

Furthermore, the process of the present invention comprises interposing explosive pipes in the gap between members, the explosive pipes each having a preformed flattened cross section and having its interior charged with explosives, detonating the charge, whereby restoring the cross sectional shape of the explosive pipe to its circular shape by the explosive force thereby pressing the explosive pipe against the members so that both the members are fixed, then closing off the gap by expanding rubber tubes and filling the gap with a filler joining material. With this arrangement, the joining of panel points for members in the marine structure may be accomplished from a suitable position on the surface of the water easily, safely and in remote control fashion. Further, even in the case where the members are subject to oscillations due to waves, water currents and the like, the panel points may be securely joined and fixed.

What is claimed is:

1. A process for connecting a brace to a pile member driven into the water characterized by providing a brace member having relatively short pipe elements at both ends of a beam member, opposedly driving a plurality of pile members in pairs into the water, placing one of said pipe elements over a first pile member placing the other of said pipe elements over a second pile member, said pipe elements having a diameter larger than the pile members, locating said pipe elements on the pile members at predetermined locations thereon with a predetermined gap between each pipe element and associated pile, filling said gap with a filler joining material to integrally join together the brace member and said piles, said brace member being free of connections with other structural members prior to joining to a pile, whereby said first and second pile members are connected to each other.

2. The process of claim 1 wherein the gap contains expandable rubber tubes, and expanding the tubes to close off the gap prior to filling with the filler joint material.

3. The process of claim 2 wherein the filler joining material is an expansive mortar having adhesive properties and which exerts expansive pressure.

4. The process of claim 1 wherein the brace member is longitudinally adjustable, and adjusting the brace member length as required by the spacing of the piles in the water.

5. The process of claim 1 wherein the brace member comprises a tie rod.

6. A process for connecting a brace to a pile member driven into the water characterized by providing a brace member having relatively short pipe elements at both ends of a beam member, opposedly driving a plurality of pile members in pairs into the water, placing one of said pipe elements over a first pile member placing the other of said pipe elements over a second pile member, said pipe elements having a diameter larger than the pile members, locating said pipe elements on the pile members at predetermined locations thereon with a predetermined gap between each pipe element and associated pile, filling said gap with a filler joining material to integrally join together the brace member and said piles, said brace member being free of connections with other structural members prior to joining to a pile, interposing an explosive pipe in said gap, said explosive pipe having a flattened circular cross section oval-like in shape and an interior charged with explosives, exploding the charge, whereby the explosive pipe expands and thereby fixes the brace member to the pile members, closing off the gap with an expanded rubber tube and filling the gap with a filler joining material.

* * * * *